United States Patent [19]

Bergamaschi

[11] Patent Number: 4,485,554

[45] Date of Patent: Dec. 4, 1984

[54] DOUBLE BLADE RAZOR HEAD WITH THREE ELEMENTS MOLDED IN CONTINUOUS MANNER

[75] Inventor: Athos Bergamaschi, Castelmaggiore, Italy

[73] Assignee: Elberel Italiana di Bergamaschi Athos, Italy

[21] Appl. No.: 497,153

[22] Filed: May 23, 1983

[30] Foreign Application Priority Data

Jan. 14, 1983 [IT] Italy ..... 9307 A/83

[51] Int. Cl.[3] ..... B26B 21/14

[52] U.S. Cl. ..... 30/50; 30/47; 30/346.58

[58] Field of Search ..... 30/47, 50, 346.57, 346.58, 30/346.59

[56] References Cited

U.S. PATENT DOCUMENTS

| | | | |
|---|---|---|---|
| 1,418,191 | 5/1922 | McGarvey | 30/50 |
| 2,336,047 | 12/1943 | Testi | 30/346.58 |
| 2,487,886 | 11/1949 | McCune | 30/50 |
| 2,694,857 | 11/1954 | Koval | 30/47 |
| 3,492,723 | 2/1970 | Mollica et al. | 30/47 |
| 4,439,920 | 4/1984 | Nauheimer | 30/47 |

*Primary Examiner*—Jimmy C. Peters

*Attorney, Agent, or Firm*—McGlew and Tuttle

[57] ABSTRACT

The razor head includes at least three parts made of plastics and connected with one another in a continuous manner along flexible zones, two blades being positioned between these parts and engaging them when said parts are turned over one upon the other in the arrangement of use; one of these three parts is located between the blades and the remaining two are arranged outside the blades.

10 Claims, 25 Drawing Figures

Fig.1
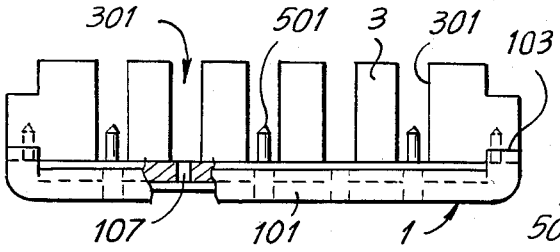
Fig.3
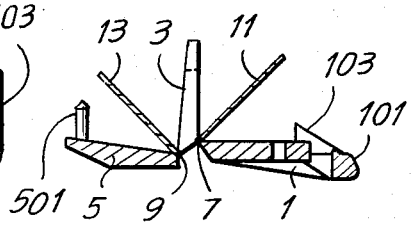
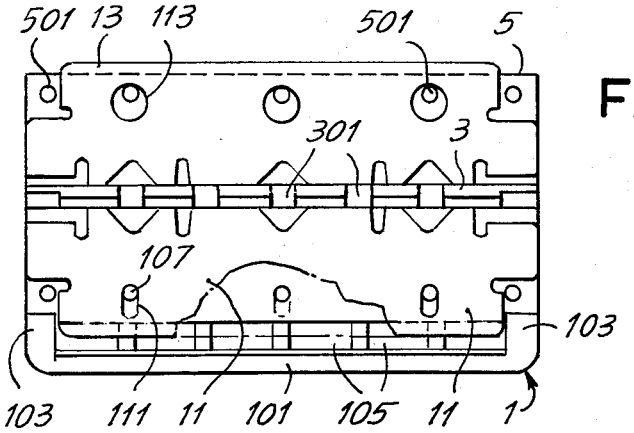
Fig.2
Fig.4
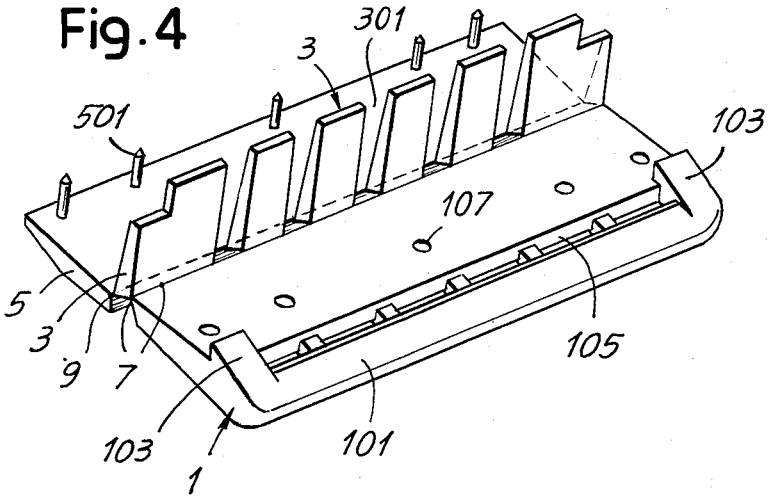

Fig.14
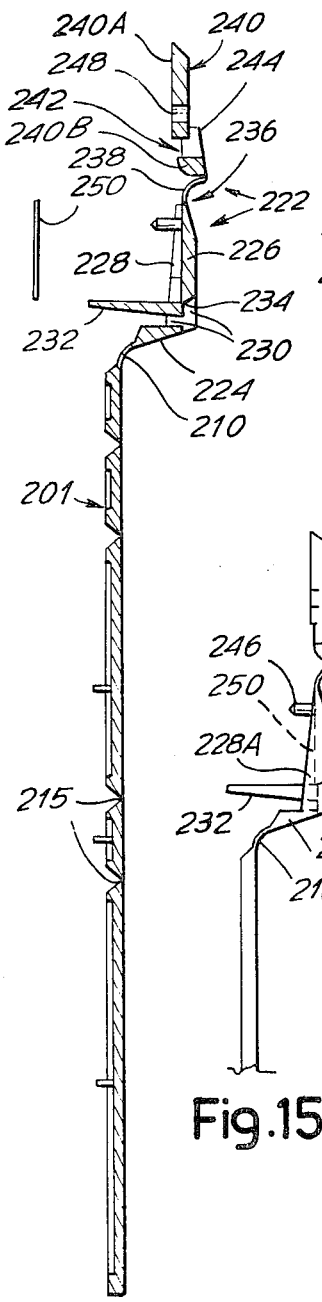
Fig.13
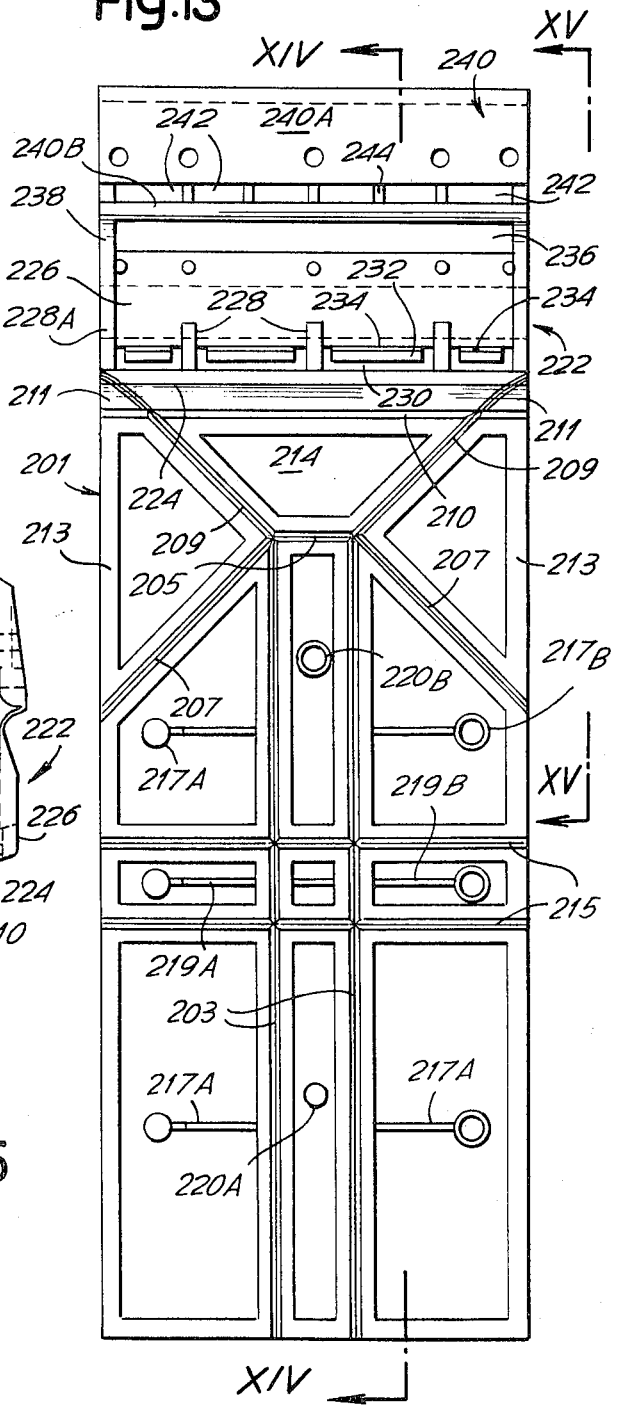
Fig.15

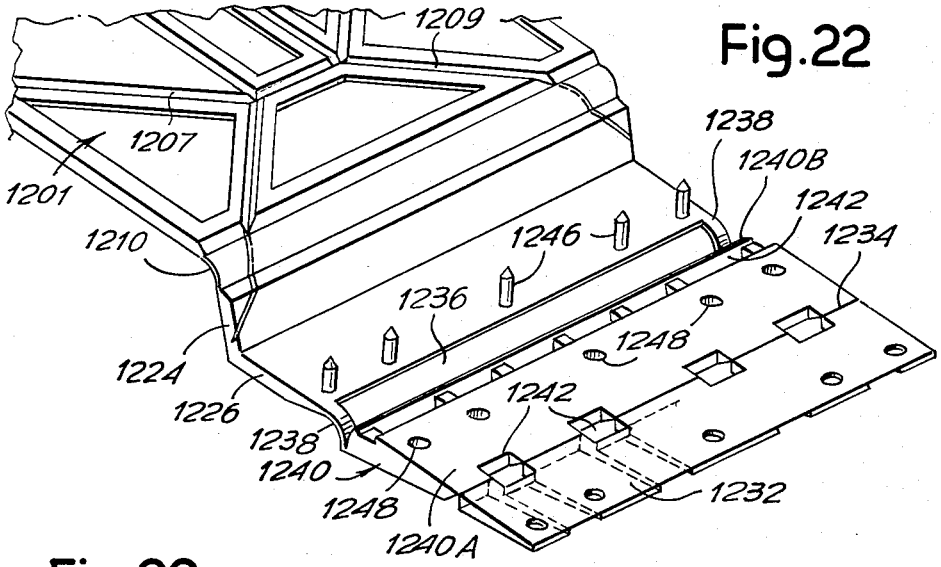
Fig.22
Fig.23
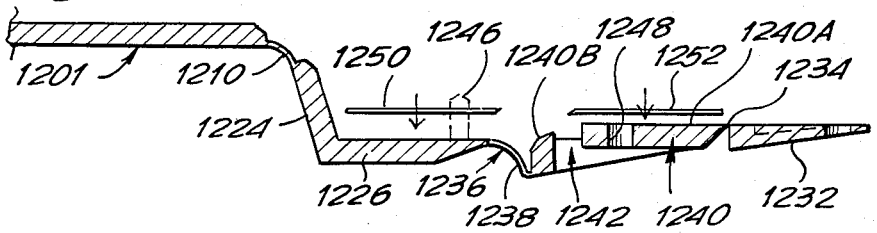
Fig.24
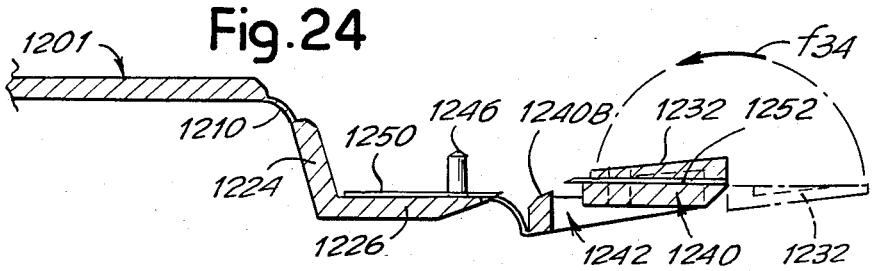
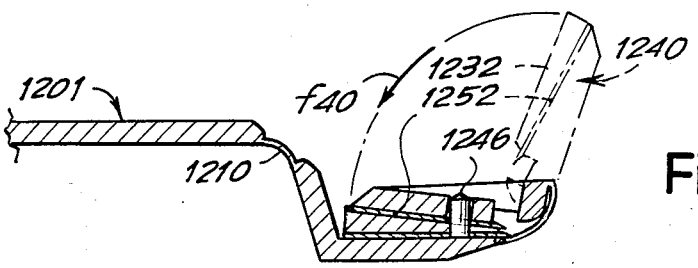
Fig.25

DOUBLE BLADE RAZOR HEAD WITH THREE ELEMENTS MOLDED IN CONTINUOUS MANNER

BACKGROUND OF THE INVENTION

Field of the Invention

The object of the invention is a razor head which is unexpensive and includes two blades designed to be used simultaneously for an improved shaving.

According to the invention, it is possible to make a razor which can be reduced into small dimensions.

These and other purposes and advantages will appear from reading the following text.

SUMMARY OF THE INVENTION

Substantially, a razor head according to the invention comprises at least three parts made of plastics and connected with one another in a continous manner along flexible zones, two blades being positioned between these parts and engaging them when said parts are turned over one upon the other in the arrangement of use, one of these three parts being located in an intermediate position between the blades and the remaining two being located outside the blades.

Said three parts are practically interconnected along two parallel lines and are advantageously interconnected with one another in a direction parallel to the cutting edge of the blades.

The intermediate part can be shaped as a wedge with a thickness decreasing towards the end corresponding to the cutting edges of the blades, whereby the blades—between which said intermediate part is located—will be slanted and close to one another at the cutting edge side.

Interruptions can be provided in the intermediate part, in which case back slots are then provided to match at least with said interruptions. In this way apertures are obtained for discharging foam and hairs.

In one embodiment, the three parts mentioned above are connected in the manner of a book with the hinges disposed side by side with the intermediate part, and the blades rest with their edge facing the sharp one on the bottom of the dihedral recesses formed by the adjacent parts. In this embodiment, appendixes for a razor head handle can be provided to be engaged at any time through said discharge slots.

In another embodiment, the two outer parts can be connected with one another through flexible bridges delimiting a slot, in which the cutting edges of the two blades protrude; in this case the intermediate part—generally in the form of a wedge—is hinged at the outside of one of the two outer parts and is first overturned on one of the outer parts. Said intermediate part—which consists preferably of a number of sections—can match at the back with a discharge slot. Further, said intermediate part can be connected to the end of a single molded piece having a substantial laminar elongated shape to also form the handle.

The invention will be better understood following the description and the annexed drawing, which shows by way of example a practical non-limitative embodiment of the same invention.

BRIEF DESCRIPTION OF THE DRAWINGS

FIGS. 1 to 3 are three geometrical views of a razor head according to the invention in the opened arrangement;

FIG. 4 is a perspective view;

FIGS. 13, 14 and 15 show a modified embodiment in a plan view, in a corss section along XIV—XIV and in a view along XV—XV of FIG. 13 respectively, in the molding arrangement;

FIGS. 21 and 22 are an extended front view and a partial perspective view of a further embodiment;

FIGS. 23, 24 and 25 show partial cross sections of three successive mounting phases.

DETAILED DESCRIPTION OF THE PREFERRED EMBODIMENTS

Figure 5:
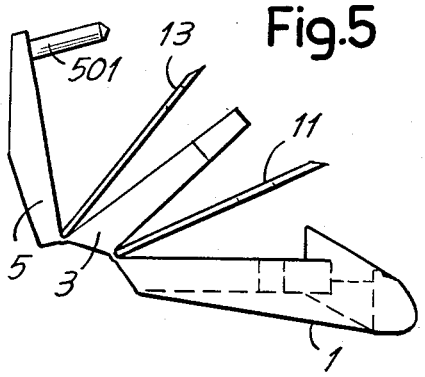
FIGS. 5, 6, 7 and 8 illustrate side and plan views of intermediate arrangements between the opened and closed arrangement.

As illustrated in the drawing, a double-bladed razor head comprises a single molded piece with three parts 1, 3 and 5 which are connected with one another in the manner of a book through flexible links by reducing their thickness, said flexible links being denoted with reference numerals 7 and 9 for the articulation of parts 1 and 3 and parts 3 and 5, respectively. Part 1 has a front shaping 101 for contacting in use the skin of the shaver and enabling the blade 11 to first act on the hairs; two check projections 103 are also provided on part 1 at the end of the profile 101. Discharge slots 105 are formed along the front shaping 101 for removal of remaining cut hairs and foam. Part 1 also comprises holes 107 in registry with larger holes 111 of blade 11.

The intermediate part 3 is advantageously shaped as a comb with wide intervals or spaces 301 leading to discharge apertures which are through spaces due to the continuity of part 3 established by means of the articulations 7 and 9. Part 3 can be wedge-shaped, i.e., its thickness decreases from the end engaged by the articulations 7 and 9 in the direction of the free end.

Part 5 is suitably profiled and has, characteristically, pins 501 in registry with the holes 107.

Figure 11:
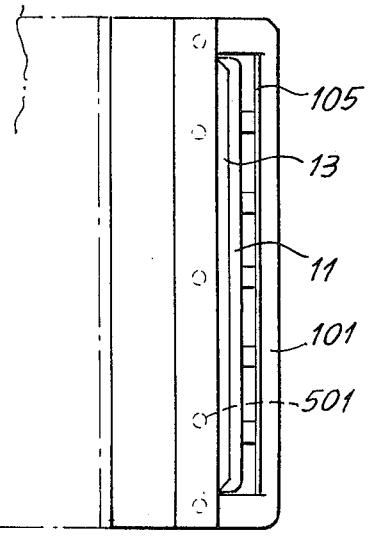
Figure 12:
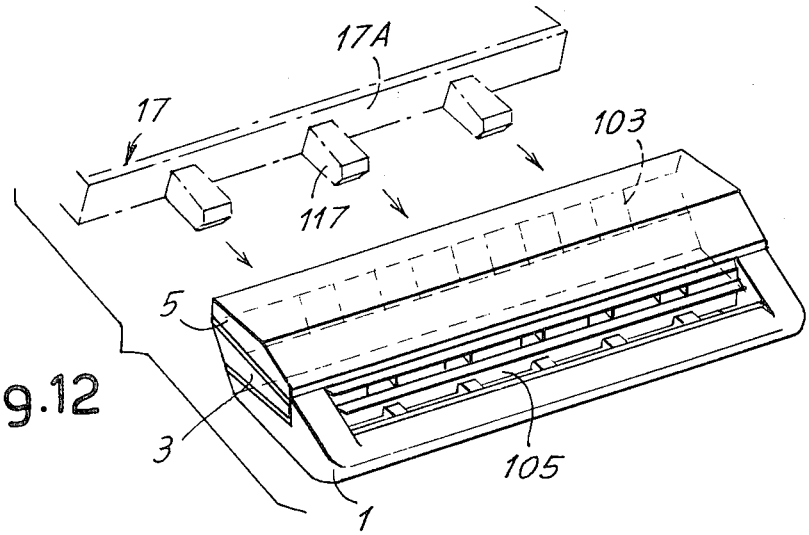
Figure 16:
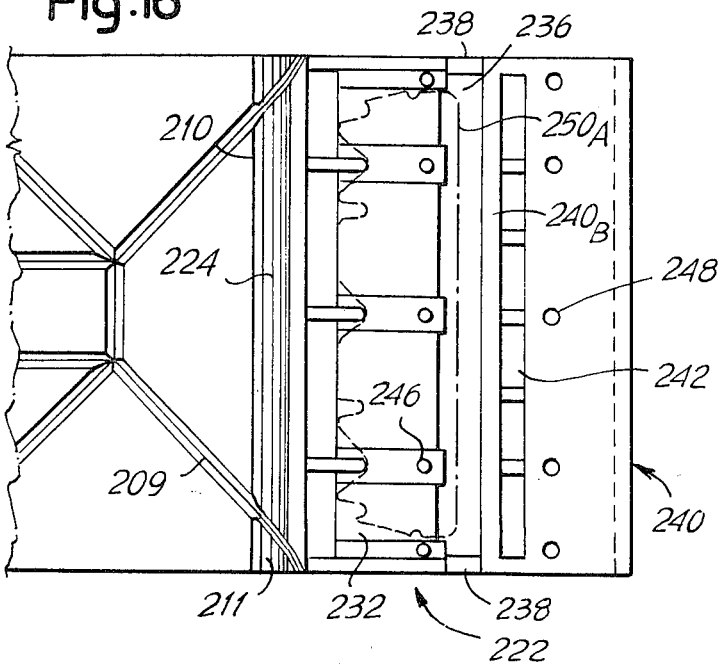
FIGS. 16 and 17 show, like FIGS. 13 and 14, an intermediate arrangement during the folding for forming the razor head.
Figure 17:
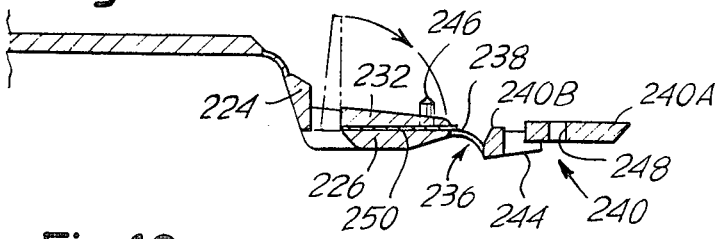
Figure 18:
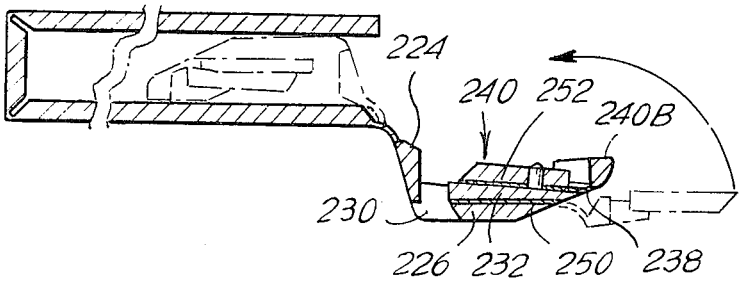
FIG. 18 is a cross section like that of FIGS. 14 and 17 of the final phase of folding.
Figure 19:
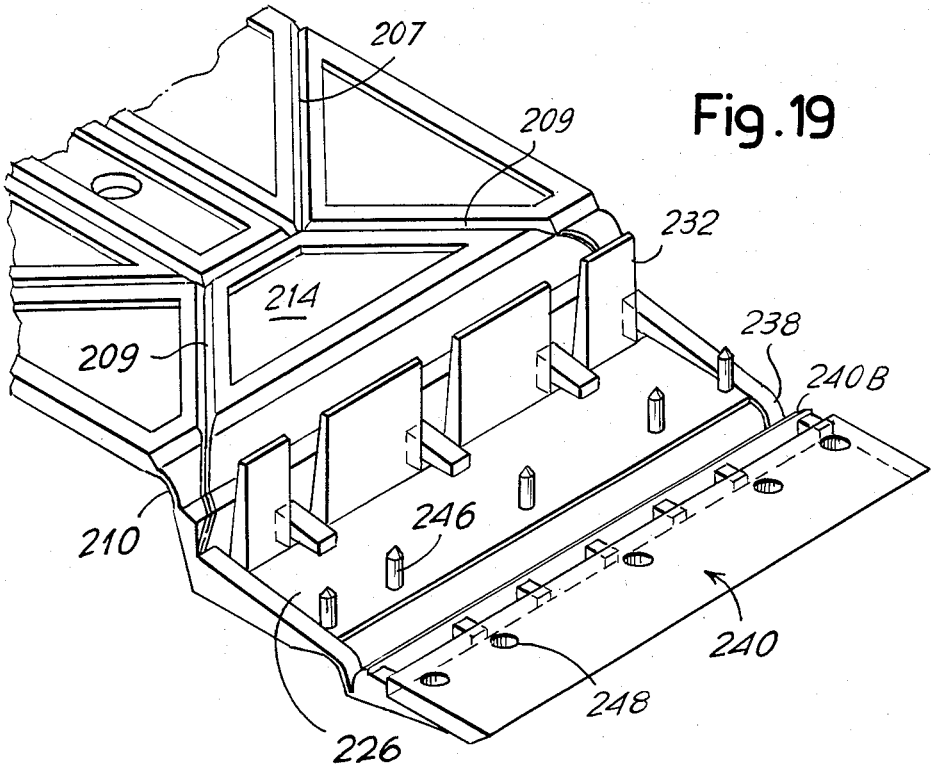
FIG. 19 is a perspective view in the opened arrangement.

Numeral 13 designates the second blade of the razor head. Blade 13 is placed between parts 3 and 5 so that its holes 113 are in registry with the pins 501 that pass through said holes when the blade rests on the dihedral vertex defined by parts 3 and 5, the hinge 9, which acts through flexibility, extending along said vertex. Blade 11 is positioned between parts 1 and 3 so as to rest on the dihedral vertex formed by said parts, the hinge 7 which acts through flexibility, extending along said vertex. Both blades 11 and 13 rest on the vertexes, defined by the hinge articulations 7 and 9 with their edges opposed to the respective cutting edges, so that these cutting edges are suitably positioned for the cut when the razor head is closed with parts 1, 3 and 5 resting on one another shifting them through the arrangements of FIGS. 5 and 7 to the arrangement of FIG. 11. In the operation of closure in the manner of a book around the hinges 7 and 9 in order to achieve the arrangement of FIG. 11 from that of FIG. 3, the pins 501 pass through the holes 113 of the blade 13 within the intervals or spaces 301 of part 3, through the holes 111 of the blade 11 and within the holes 107 of the part 1; in this way the blades are held in position between the hinges 7 and 9 and the pins 501. The blades are engaged between the parts 1 and 3, and respectively 3 and 5; since part 3 is located between the blades 11 and 13, the latter are slightly slanted with each other relative to the wedge-shaped profile of part 3; the mutual inclination between the blades 1 and 3 is suitable for an additional cutting action performed by the two blades.

Figure 10:
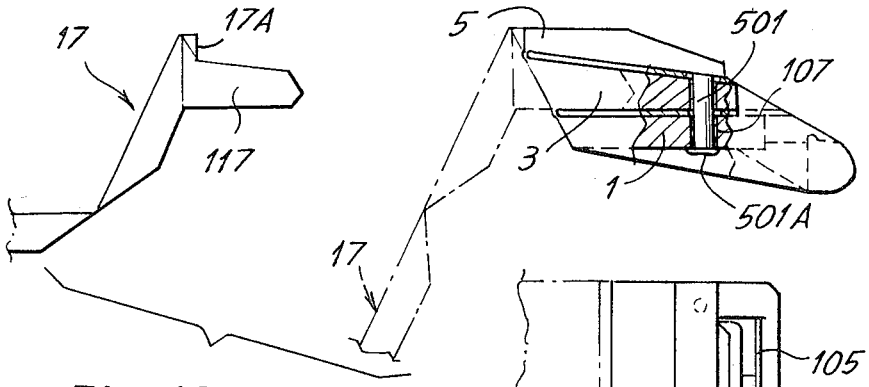
FIGS. 10, 11 and 12 are a side, a plan and a perspective view of the closed razor head with a handle portion which can be fixed thereto.

The arrangement of closure of the razor head can be stabilized by means of plastic deformation, i.e., riveting and plasticating the ends of pins 501 protruding through and beyond the holes 107 from the part opposed to the blade 11 with respect to the part 1, as indicated at 501A in FIG. 10. The pins 501 at the lateral ends do not pass through the holes 111 and 113 of the blades 11 and 13, but are disposed along said blades outside a step profile which is provided in the blades, at the end of the respective cutting edges.

As already mentioned, the intervals or spaces 301 of the comb-shaped intermediate portion 3 of the razor head extend to form through apertures between the hinges 7 and 9. In the arrangement of closure of FIG. 10, the intervals or spaces 301 form in practice back openings on the razor head; these openings are useful to engage the razor head to a handle 17, of suitable shape which is further provided with a plurality of spaced apart appendixes 117 on the front 17A. Said appendixes are arranged so that they project into the spaces or some of the spaces 103, to exert a pressure inside of them and engage the razor head for use. The shape of the appendixes 117 can suitably include widened portions and forked sections respectively to provide resilient expansion, or other means to hold the razor head through resilient release, friction or the like.

Figure 7:
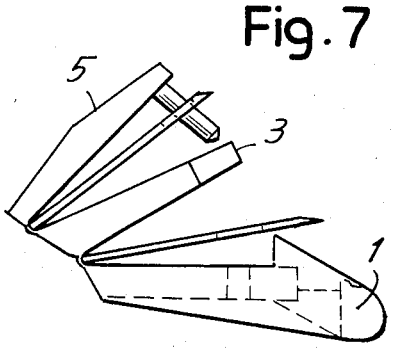
Figure 6:
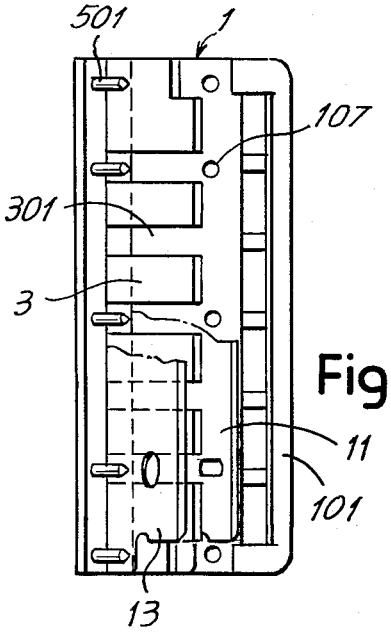
Figure 8:
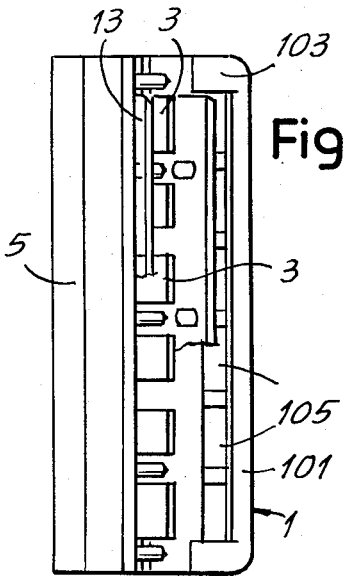
Figure 9:
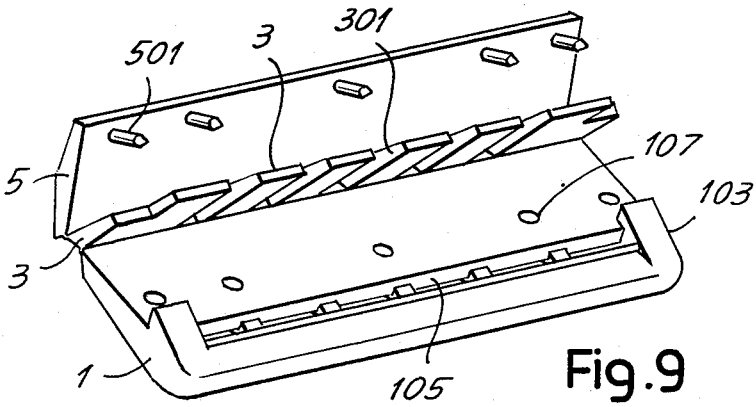
FIG. 9 is a perspective view.

The razor head formed with elements 1, 3, 5, 7 and 9 can be easily molded in the arrangement shown in FIGS. 1 to 4 and can also be easily manipulated to receive the blades before or during book-folding as shown in the arrangements of FIGS. 5 and 7 and to engage the blades in the arrangement of FIG. 10. In substance, this razor head allows an easy mounting operation and an accurate positioning of the blades.

As illustrated in FIGS. 13 to 19, numeral 201 denotes a substantially flat rectangular element with lines of reduced thickness which makes it possible for the material to be folded by forming hinges in a continuous manner and exploiting the capacity of said material to be plastically and somewhat resiliently deformed. More particularly, two longitudinal folding lines 203 are provided ending at a transversal line 205, two pairs symmetrical slanted folding lines 207 and 209 extending from the extremes thereof. These lines 209 cross a transversal folding line 210 to define two triangles 211 adjacent two triangular zones 213 defined between lines 207 and 209. The lines 209, 205 and 210 define a trapezoidal zone 214. Beyond the transversal folding line 210 the razor head to be described below extends with rigid and flexible parts. Two additional transversal folding lines 215 are formed in an intermediate position along the length of the element 201, between the end and the folding line 210. Numerals 217A, 217B and 219A, 219B denote projections of particular shape designed to cooperate to connect symmetrical parts of the element 201 in the arrangement folded along lines 203, while similar projections 220A, 220B have the purpose to stabilize the folding position along the transversal lines 215. This arrangement allows the element 201 to be folded from the stretched arrangement into an extended and rigid arrangement to form the handle for using the razor, the razor head being formed by an extension 222 of the element 201 beyond the folding line 210; this arrangement allows the razor head to be fixedly maintained in an inclined position with respect to the handle for use, due to the provision of triangles 211 and folding lines 209. All this is clearly shown in FIG. 20. From the stretched arrangement, the element 201 can be folded along lines 215 so as to reduce its length and overturn with each other the two parts into which it is subdivided by said lines 215, folding inside the razor head. Thus the razor can be kept in its smallest dimensions.

Beyond the line 210, the portion 222, which will form the razor head, has a rigid zone formed by a portion 224 and a portion 226 interconnected by means of intermediate ribs 228 and end ribs 228A; these two portions 224 and 226 are separated by a long slot 230 which is interrupted by the ribs 228 and delimited at its ends by the ribs 228A. Between adjacent ribs at the slot 230, appendixes 232 are provided having a similar wedge-shaped profile; said appendixes 232 are molded to be continuous along folding lines 234 by means of which they are connected to the portion 226 and can bend with respect to said portion until they lie on it from the substantially orthogonal molding arrangement as shown in FIGS. 14 and 15. In these Figures it can be seen that the appendixes 232 originate at the slot 230 and between adjacent ribs 228 or 228A leaving spacings therebetween.

The portion 226 is further delimited by a wide transverse slot 236, which is delimited at its ends by two flexible bridges 238. These two bridges 238 are connected to a peculiarly shaped end portion 240 which includes a flat section 240A, a row of transversely aligned slots 242 defined by ribs 244, and a second section 240B delimiting the slot 236.

In alignment with the intervals between adjacent appendixes 232 on portion 226 there is a set of protruding pins 246, and through holes 248 are formed in the flat section 240A to be in registry with them.

In order to form with the part 222 a twin-blade razor head, a first blade 250 is disposed against the portion 226, said blade comprising holes in registry with pins 246; the blade has a positioning edge coinciding with the hinge corner 234 between the portion 226 and the appendixes 232 and having its cutting edge 250 in registry with the elongated slot 236. After positioning the blade 250 as mentioned above, the appendixes 232 are shifted downward from the arrangement of FIGS. 14 and 15 to the arrangement of FIGS. 16 and 17, whereby the appendixes 232 will lie on the blade 250 and the latter is located between the portion 226 and the appendixes 232. Immediately afterward a second blade 252 is arranged to lie on the appendixes 232; this blade is positioned by means of pins 246 or the like so that its cutting edge is also in registry with the slot 236. Then, by bending the bridges 238 the portion 240 is overturned on the blade 252, from the arrangement of FIG. 17 to the arrangement of FIG. 18, which shows that the holes 248 receive the pins 246. The twin-blade razor head is thus formed and its stabilization—shown in the arrangement of FIG. 18—can be achieved by means of thermoplastic deformation and riveting of the pins 246 in a suitable flaring of the holes 248.

It should be noted that since the appendixes 232 are wedge-shaped, a limited mutual inclination between blades 250 and 252 is obtained, so that the cutting edges of the latter are positioned along the closest corners near the opening defined by the slot 236 after bending and overturning the portion 240 on the appendixes 232.

The slots 242 are openings for the outlet and discharge of the foam and cut hairs. Further outlet and discharge openings are represented by the passages between adjacent appendixes 232, which passages communicate with the slot 230.

Figure 20:
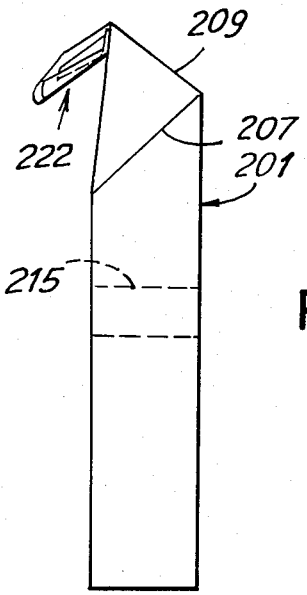
FIG. 20 shows an arrangement for use.

The razor head, which is formed by the coupled elements 226, 232, 240 rigidly connected to the portion 224, is stiffened in a slanted position with respect to the handle folded along the lines 203, as shown in FIG. 20, thanks to the folding lines 209 extending between the triangles 211 and the portion 224. Thus it is possible for the razor in the folded arrangement shown as an example with dashed lines in FIG. 18 to be stretched and then folded to form the handle in the arrangement illustrated in FIG. 20.

Figure 21:
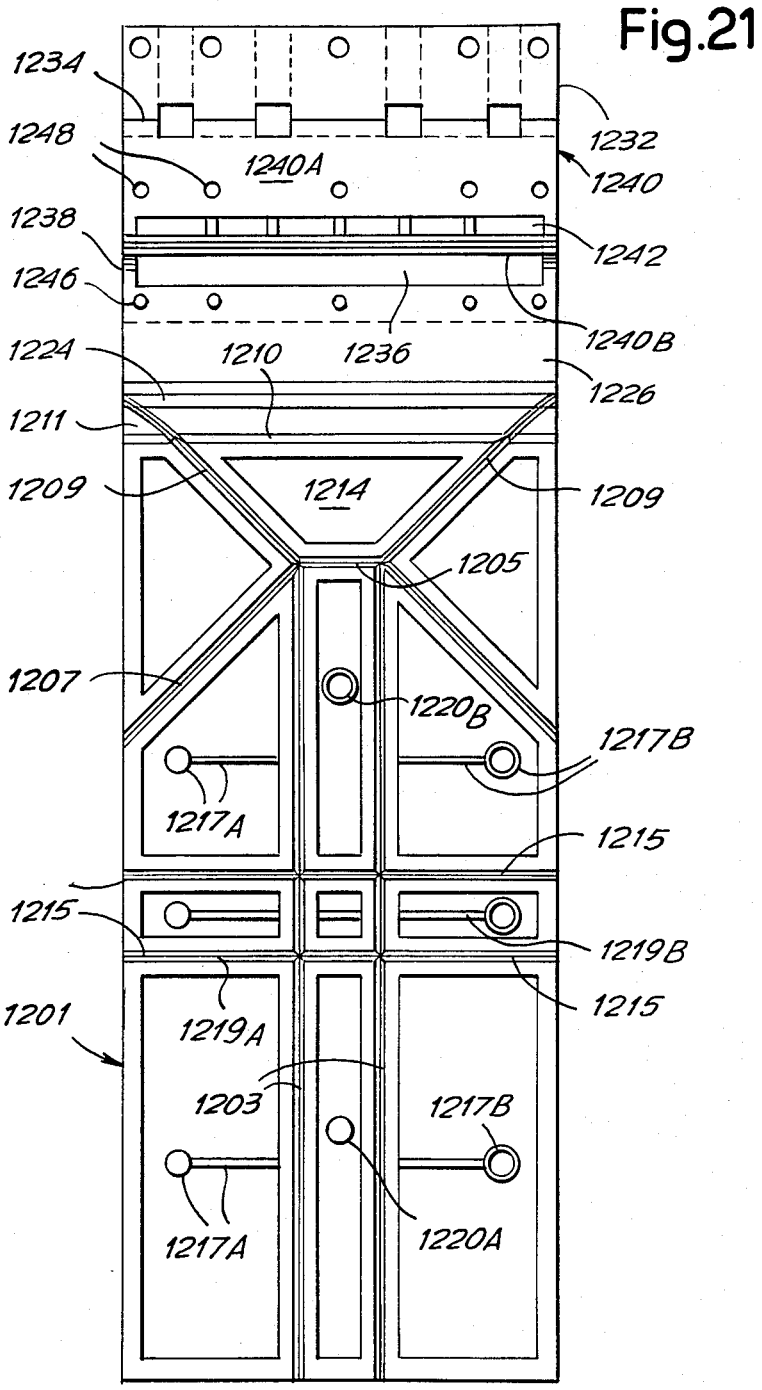

FIG. 21 and the following illustrate an embodiment which has been modified with respect to the previous one. In this embodiment—in which reference numerals corresponding to those of the preceding examples are increased by "1000"—two portions 1224 and 1226 extend in a similar manner as the corresponding portions 224 and 226; the portion 1226 is connected by means of bridges 1238 to the portion 1240B, 1240A which is analogous to the two sections 240B, 240A of the portion 240 of the previous example; there are also provided a number of slots 1242 like those 242 and, advantageously, a slot 1230 like that 230.

In this embodiment—instead of appendixes 232 hinged to part 226—appendixes 1232 are provided which are hinged along the folding lines 1234 to the end of the part 1240A; also these appendixes 1232 are in the form of a wedge. From the molding arrangement shown by dotted lines in FIG. 21, the set of appendixes 1232 is turned over around the hinge 1234 following arrow f34 by interposing the first blade 1250, whose cutting edge will thus match the slot corresponding to that 236 between the bridges 1238. The second blade 1252 is then disposed on the part 1226 or, alternatively, on the appendixes 1232, and the unit 1240A, 1240B, 1250, 1232, is then turned over following arrow f40 so that it can achieve the arrangement of FIG. 22 by bending the bridges 1238. This arrangement can be stabilized by means of deformable pins 1246, which are received in holes 1248 of the section 1240A and in corresponding holes in the section 1232, in the same manner as pins 246.

The body 1224 can also in this case be developed by a laminar element 1201, like that 201, forming the handle.

It is intended that the drawing shows only an embodiment given merely as a practical demostration of the invention, which invention can vary in the forms and arrangements without anyway departing from the scope of the idea informing the invention itself.

What is claimed is:

1. A razor head comprising: at least three parts made of plastic which are hinged with one another along flexible zones in a continuous manner; two blades located and engaged between said parts when said parts are overturned on one another in the arrangement of use, while one of these three parts is located in an intermediate position between the blades and the remaining two parts outside the blades.

2. A razor blade as in claim 1, characterized in that said three parts are hinged with one another along two parallel lines.

3. A razor head as in claim 2, characterized in that said three parts are hinged with one another in a parallel direction to the cutting edge of the blades.

4. A razor head as in claim 3, characterized in that the intermediate part is in the form of a wedge of decreasing thickness towards the end corresponding the blade cutting edges, whereby the blades—between which said intermediate part is located—are disposed inclined with each other and close at the side of the cutting edges.

5. A razor head as in claim 3, characterized in that the intermediated part is formed with interruptions and that back slots are provided to match at least with said interruptions.

6. A razor head as in claim 3, characterized in that said three parts are connected in the manner of a book with the hinges lying side by side the intermediate part, and the blades rest with the edge opposed to the cutting one in the bottom of the dihedral recesses formed by the adjacent parts.

7. A razor head as in claim 6, characterized in that appendixes of a handle for the razor head are engaged through said slots.

8. A razor head as in claim 5, characterized in that the two outer parts are articulated with each other through flexible bridges delimiting a slot into which the cutting edges of the two blades project; and that the intermediate part, generally wedge shaped, is hinged to the outside of one of the two outer parts and is first turned over on one of the outer parts.

9. A razor head as in claim 8, characterized in that the intermediate part, preferably made of a plurality of sections, matches at the back with a discharge slot.

10. A razor head as in claim 8, characterized in that the intermediate part is hinged to the end of a single molded piece of a substantially laminar shape to also form the handle.

* * * * *